US008613427B2

(12) United States Patent
Lawson et al.

(10) Patent No.: US 8,613,427 B2
(45) Date of Patent: Dec. 24, 2013

(54) HOIST LOCK BLOCK

(75) Inventors: Scott L. Lawson, Pinehurst, NC (US); Richard L. Caviness, Robbins, NC (US); David V. Sykes, Broadway, NC (US); David A. Eichenberger, Sanford, NC (US)

(73) Assignee: Ingersoll Rand Company, Davidson, NC (US)

( * ) Notice: Subject to any disclaimer, the term of this patent is extended or adjusted under 35 U.S.C. 154(b) by 0 days.

(21) Appl. No.: 13/390,009

(22) PCT Filed: Oct. 15, 2009

(86) PCT No.: PCT/US2009/060755
§ 371 (c)(1),
(2), (4) Date: Feb. 10, 2012

(87) PCT Pub. No.: WO2011/046554
PCT Pub. Date: Apr. 21, 2011

(65) Prior Publication Data

US 2012/0187356 A1 Jul. 26, 2012

(51) Int. Cl.
*B66D 1/00* (2006.01)

(52) U.S. Cl.
USPC ..... 254/332

(58) Field of Classification Search
USPC ..... 254/272, 332, 358, 362, 413, 415; 403/3–4; 294/85, 82.15
See application file for complete search history.

(56) References Cited

U.S. PATENT DOCUMENTS 3,339,872 A 9/1967 Eggleton, Jr.
5,749,697 A 5/1998 Davis
6,491,329 B1 * 12/2002 Smith ..... 294/82.1
2004/0083710 A1 5/2004 Hungerford
2005/0232740 A1 10/2005 Cummings
2007/0181862 A1 8/2007 Hossler
2008/0023681 A1 1/2008 Cunningham
2008/0173851 A1 * 7/2008 Xia et al. ..... 254/358
2009/0067971 A1 3/2009 Chadwick
2009/0200529 A1 8/2009 Haigh et al.

OTHER PUBLICATIONS

PCT/US2009/060755 International Preliminary Report on Patentability dated Apr. 26, 2012 (8 pages).
PCT/US2009/060755 International Search Report dated Jan. 7, 2010 (1 page).
EP13170563.4 Extended European Search Report dated Jul. 3, 2013 (5 pages).
PCT/US2009/060755 Extended European Search for Application No. 09850469.9 date Apr. 25, 2013 (5 pages).

* cited by examiner

*Primary Examiner* — Emmanuel M Marcelo
*Assistant Examiner* — Angela Caligiuri
(74) *Attorney, Agent, or Firm* — Michael Best & Friedrich LLP

(57) ABSTRACT

A hoist assembly for overhead lifting including an upwardly extending attachment member, a downwardly depending shank coupled to the attachment member and having a polygonal cross sectional shape, a hoist body coupled to the downwardly depending shank, and a plate positioned between the upwardly extending attachment member and the hoist body, that defines a first circular aperture that matingly receives the polygonal shank and a second polygonal aperture laterally spaced from the first circular aperture. The plate is moveable between a first position, in which the polygonal shank extends into the first circular aperture, and a second position, in which the polygonal shank extends into the second polygonal aperture. Rotation of the attachment member with respect to the plate is permitted when the plate is in the first position, and rotation of the attachment member with respect to the plate is inhibited when the plate is in the second position.

20 Claims, 9 Drawing Sheets

HOIST LOCK BLOCK

BACKGROUND

The present invention relates to hoists and the connection between a hoist and a machine, track, arm or other structure.

SUMMARY

In one embodiment, the invention provides a hoist assembly for overhead lifting. The hoist assembly including an upwardly extending attachment member, a downwardly depending shank coupled to the attachment member and having a polygonal cross sectional shape and a hoist body coupled to the downwardly depending shank. The hoist assembly further includes a plate, positioned between the upwardly extending attachment member and the hoist body, that defines a first circular aperture that matingly receives the polygonal shank and a second polygonal aperture laterally spaced from the first circular aperture. The plate is moveable between a first position, in which the polygonal shank extends into the first circular aperture, and a second position, in which the polygonal shank extends into the second polygonal aperture. Rotation of the attachment member with respect to the plate is permitted when the plate is in the first position, and rotation of the attachment member with respect to the plate is inhibited when the plate is in the second position.

In another embodiment the invention provides a method of coupling an attachment member to a hoist body. The method includes positioning a plate between the attachment member and the hoist body in a first plate position; the plate has a first aperture and a second aperture. The method further includes inserting a shank of the attachment member through the first aperture into a mating recess in the hoist body to couple the attachment member to the hoist body, rotating the hoist body with respect to the attachment member and extracting the shank from the hoist body. The method further includes moving the plate from the first plate position to a second plate position, inserting the shank through the second aperture into the mating recess in the hoist body to couple the attachment member to the hoist body, and inhibiting rotation of the hoist body with respect to the attachment member.

In another embodiment, the invention provides an attachment assembly for coupling a hoist body to a support structure to selectively permit and inhibit rotation of the hoist body with respect to the support structure. The attachment assembly includes an attachment member having a first end and a second end, the first end is connectable to the support structure, and the second end defines a shank having a polygonal cross sectional shape. The attachment assembly further includes a receiving member that defines a through hole sized to receive the shank and permit rotation of the shank with respect to the receiving member, and a key member defining a first circular aperture and a second polygonal aperture spaced from the first aperture. In a first position, the shank extends into the first circular aperture to permit rotation of the attachment member with respect to the receiving member, and in a second position, the shank extends into the second polygonal aperture to inhibit rotation of the attachment member with respect to the receiving member.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Figure 1:
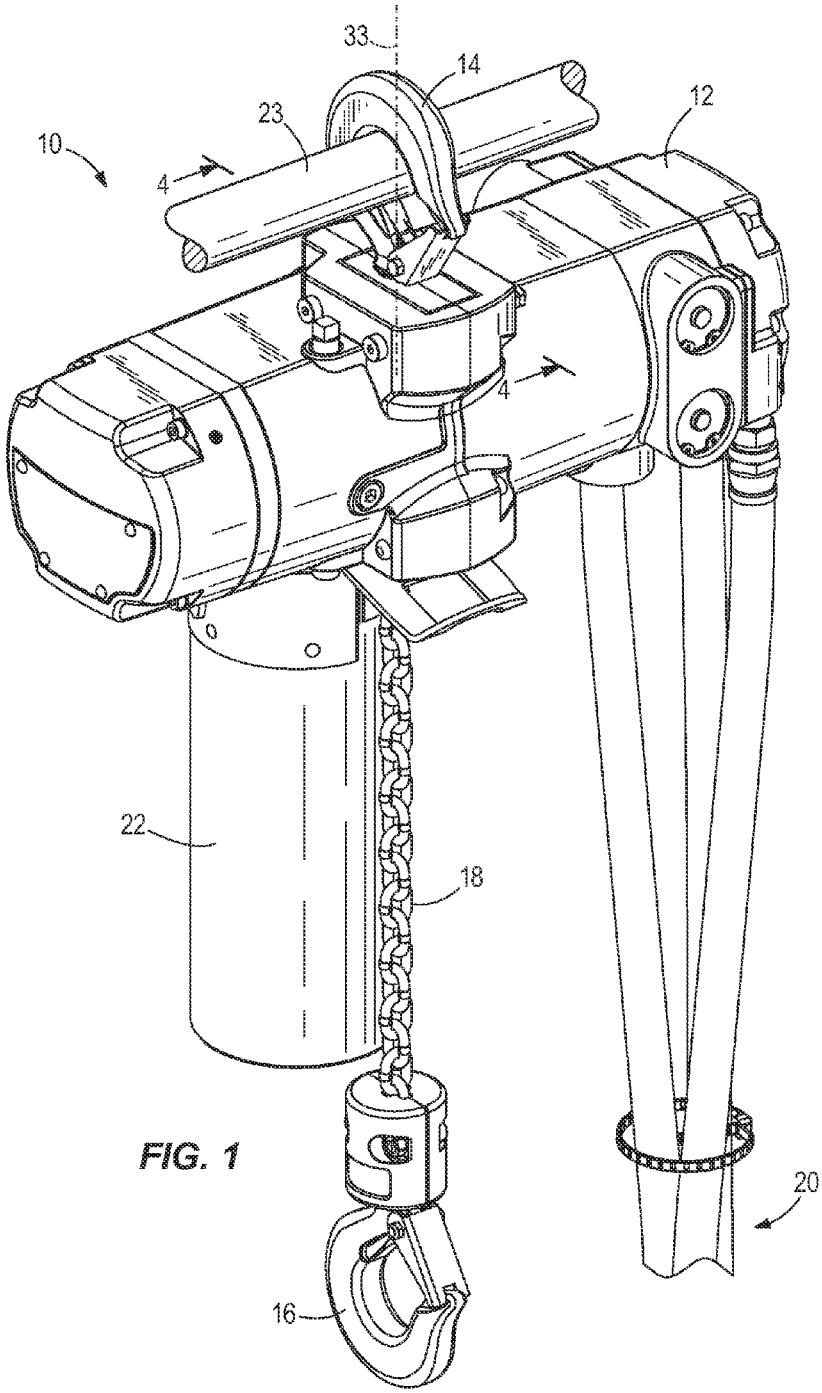
FIG. 1 is a perspective view of a hoist assembly according to one embodiment of the present invention.

FIG. 1 illustrates a hoist assembly 10 that includes a hoist body 12, a first attachment member, such as the illustrated top hook 14, coupled to the hoist body 12, a second attachment member, such as the illustrated bottom hook 16, coupled to the hoist body 12 via a chain 18, and a plurality of cables 20 coupled to the hoist body 12. The cables are operable to move the chain 18 with respect to the hoist body 12 in response to user actuation. Movement of the chain 18 with respect to the hoist body 12 thereby alters the distance between the bottom hook 16 and the hoist body 12. A chain bag 22 is utilized to store excess length of chain 18 as the bottom hook 16 is moved toward the hoist body 12. The illustrated top hook 14 engages a support structure 23 to couple the hoist body 12 to the support structure 23.

Figure 2:
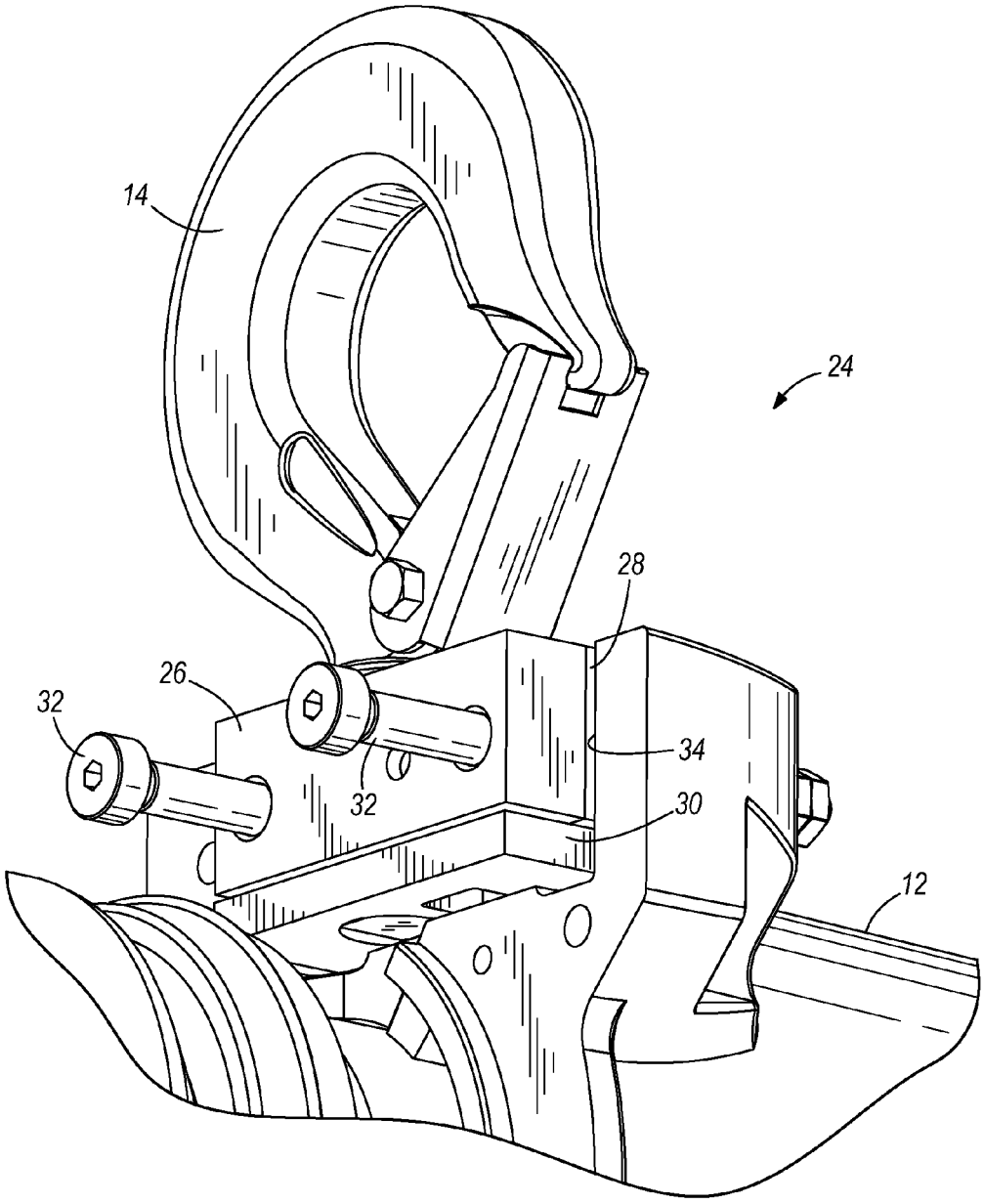
FIG. 2 is a close up perspective view of a first portion of the hoist assembly with a portion of a hoist body removed to show an attachment assembly.

FIG. 2 is a close up view of FIG. 1 with a portion of the hoist body 12 removed to show an attachment assembly 24. The attachment assembly 24 includes the hop hook 14, a first block 26, a second block 28, a plate 30, a pair of fasteners 32, and a fastener 52 (see FIG. 5). The pair of fasteners 32 extend through the hoist body 12, the first block 26 and the second block 28 to secure the top hook 14 to the hoist body 12. The hoist body 12 defines a blind hole 34, such as a recess, that receives at least a portion of the first and second blocks 26, 28 and the plate 30. The first and second blocks 26, 28 are not rotatable about a vertical axis 33 within the hole 34, and are consequently fixed for rotation about the vertical axis 33 with the hoist body 12. Although first and second blocks 26, 28 are illustrated, other quantities, shapes and constructions of parts can be utilized. Although the illustrated fasteners 32 include shoulder bolts with respective washers and nuts, other fasteners can be utilized to couple the attachment assembly 24 to the hoist body 12.

Figure 3:
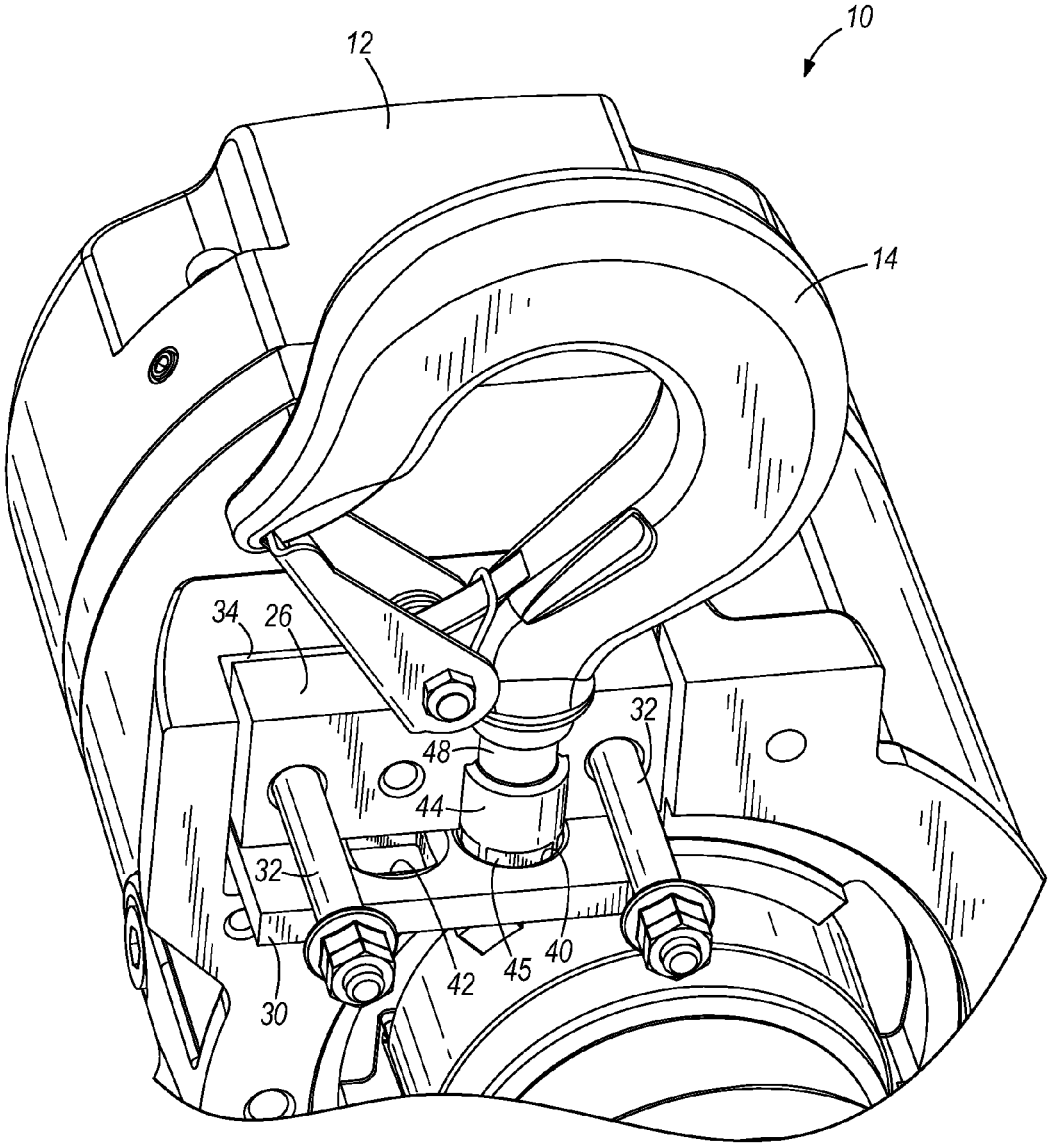
FIG. 3 is a close up perspective view of a second portion of the hoist assembly with a portion of the hoist body removed to show the attachment assembly.

FIG. 3 further illustrates the hoist assembly 10 with the second block 28 and a different portion of the hoist body 12 removed to further illustrate the blind hole 34 and the plate 30. The plate 30, or key member, defines a first aperture 40 having a substantially circular cross-section and a second aperture 42 having a polygonal cross-section. The top hook 14 includes a shank 44 connected to the hook at one end and includes an opposite polygonal end 45. The shank 44 is at least partially received in the first and second blocks 26, 28 and in the first aperture 40 in the plate 30.

Figure 4:
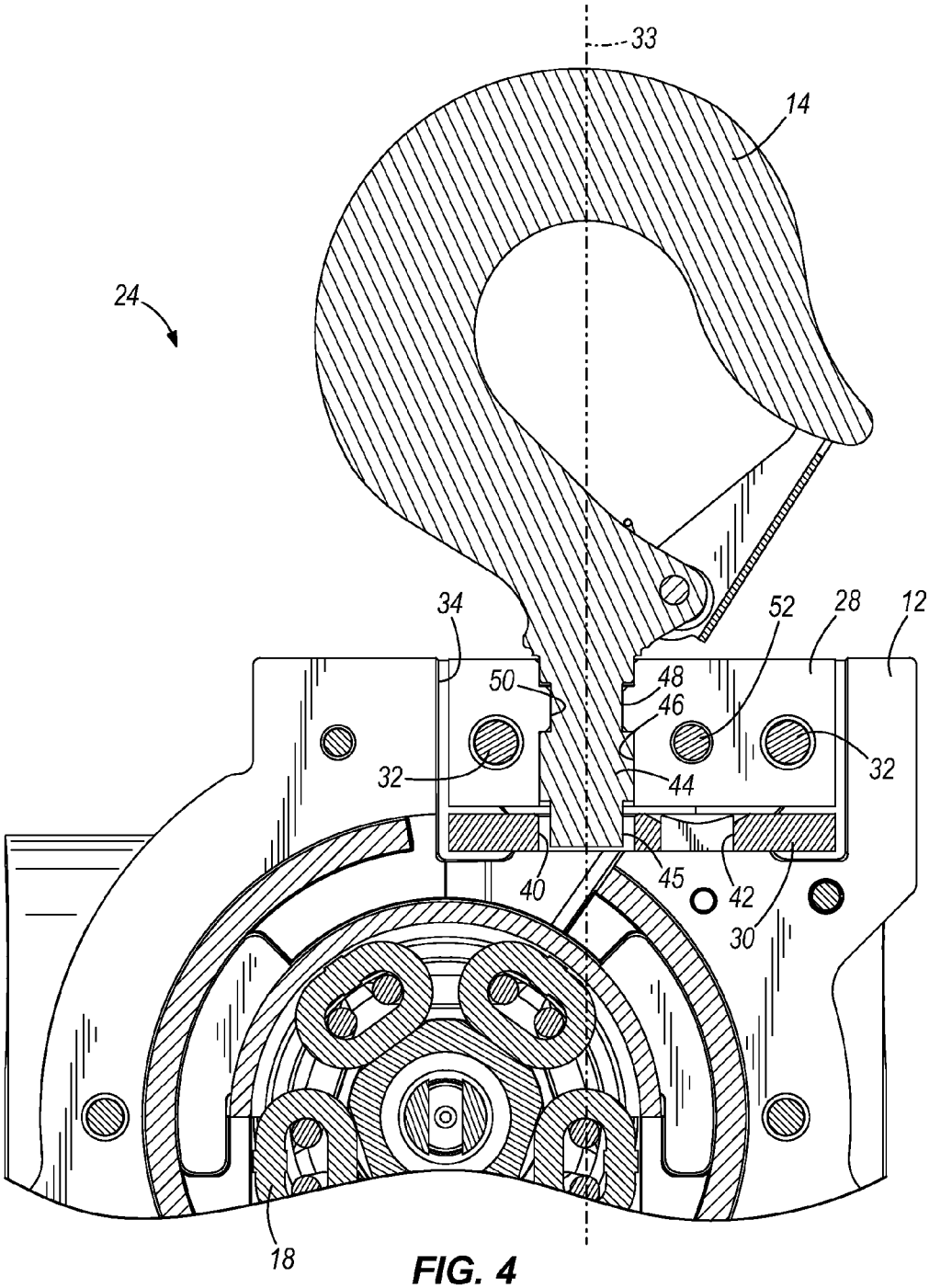
FIG. 4 is a cross-sectional view taken along line 4-4 of FIG. 1 with a plate in a first position.

FIG. 4 shows the shank 44 extending through the second block 28 and into the first aperture 40 of the plate 30. The first and second blocks 26, 28 each define a depression 46*a*, 46*b*, respectively (see FIG. 5), that together form an opening 46 sized to receive the shank 44. The shank 44 includes an annular recess 48 that is sized to receive an annular rib 50 in the opening 46 formed between the first and second blocks 26, 28. The engagement of the annular rib 50 in the annular recess 48 retains the shank 44 of the top hook 14 in the first and second blocks 26, 28. The shank 44 is permitted to rotate within the opening 46 relative to the blocks 26, 28.

FIGS. 2-6 show the attachment assembly 24 with the plate 30 in a first orientation with respect to the shank 44. In the first orientation, the shank 44 extends through the opening 46 and the polygonal end 45 is at least partially received in the first aperture 40. Consequently, the hoist body 12, first block 26, second block 28 and plate 30 freely rotate about the vertical axis 33 with respect to the top hook 14 when the attachment assembly 24 is in the first orientation. The first aperture 40 is sized to receive the polygonal end 45 of the shank 44 and permit rotation of the polygonal end 45 within the first aperture 40.

Figure 5:
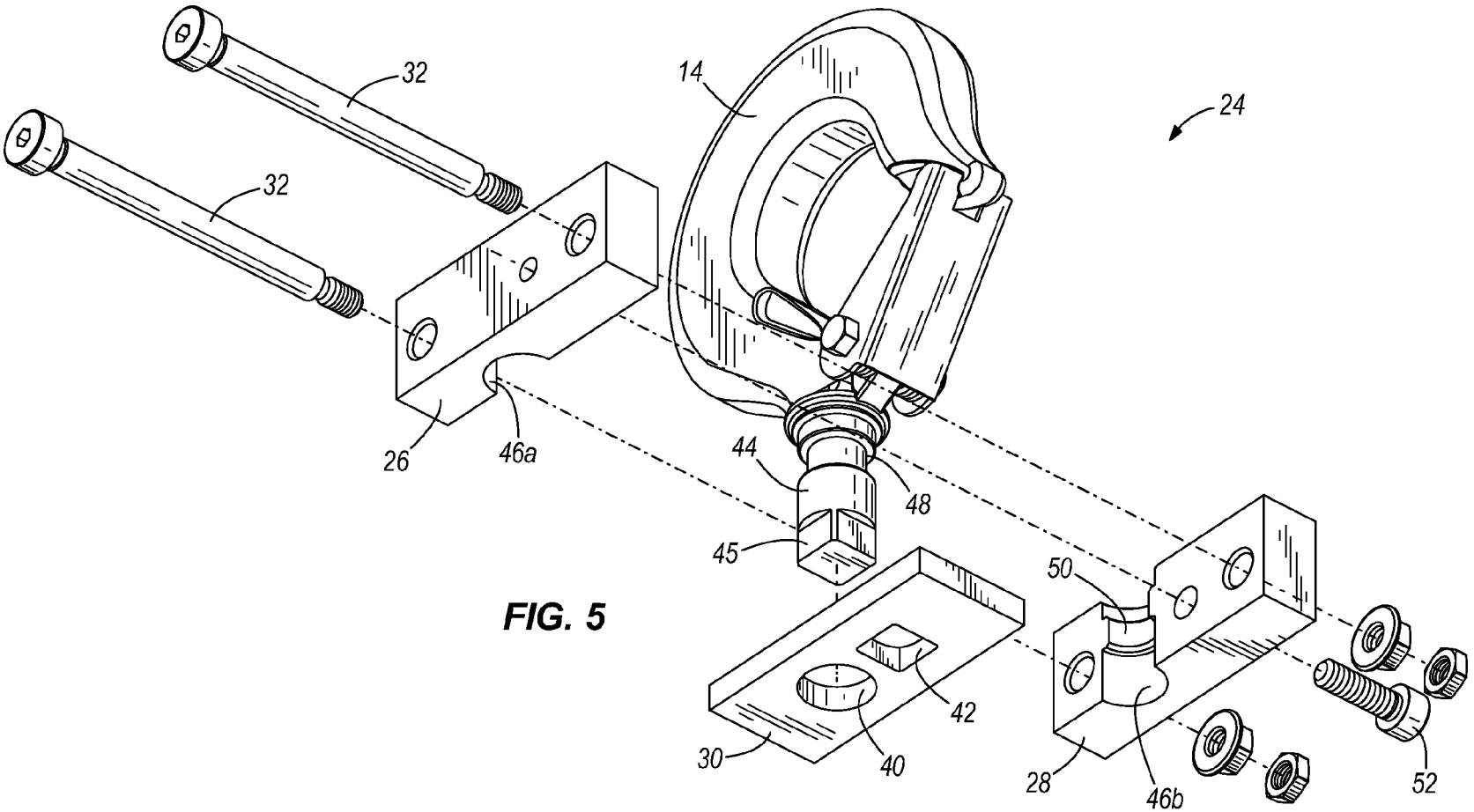
FIG. 5 is an exploded view of a portion of the hoist assembly of FIG. 1.
Figure 6:
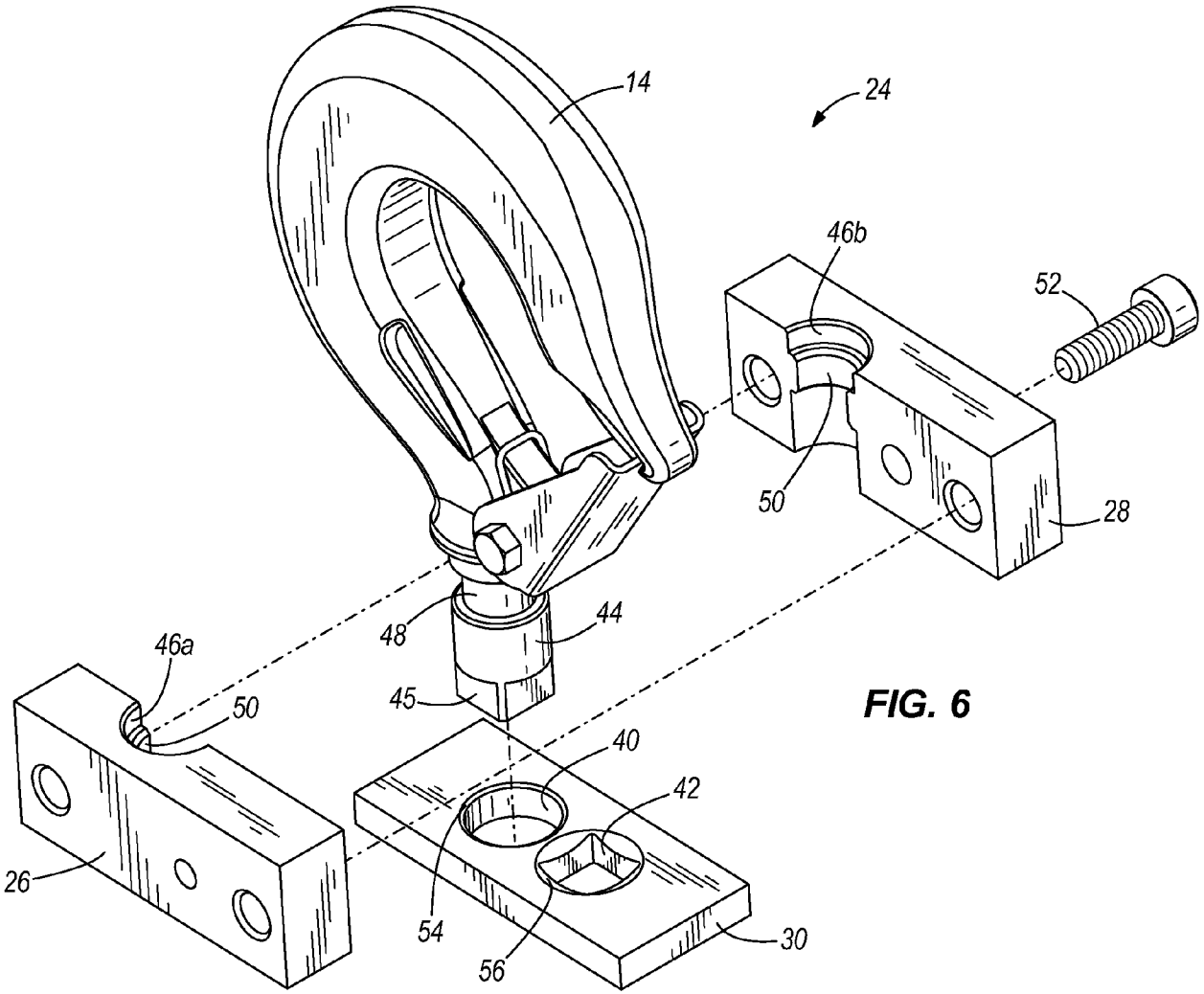
FIG. 6 is an exploded view of a hook sub-assembly of FIG. 1 including a plate in the first position.

As shown in FIGS. 4-6, the fastener 52 is inserted through an aperture in the second block 28 and threaded into an aperture in the first block 26 to couple the first block 26 to the second block 28, and thereby retain the shank 44 within the opening 46 formed between the first and second blocks 26, 28. Other fasteners, or methods of fastening can be utilized to removably couple the first and second blocks 26, 28 together.

FIG. 6 shows that the plate 30 defines a first bevel 54 around the first aperture 40 and a second bevel 56 around the second aperture 42. The first and second bevels 54 and 56, guide the polygonal end 45 of the shank 44 into the respective aperture 40, 42. The illustrated bevels 54 and 56 are shown by way of example only and are not intended to limit the scope of the present invention. Other configurations and arrangements of the plate and the apertures are possible and can be utilized in addition to or in lieu of the illustrated structure.

Figure 7:
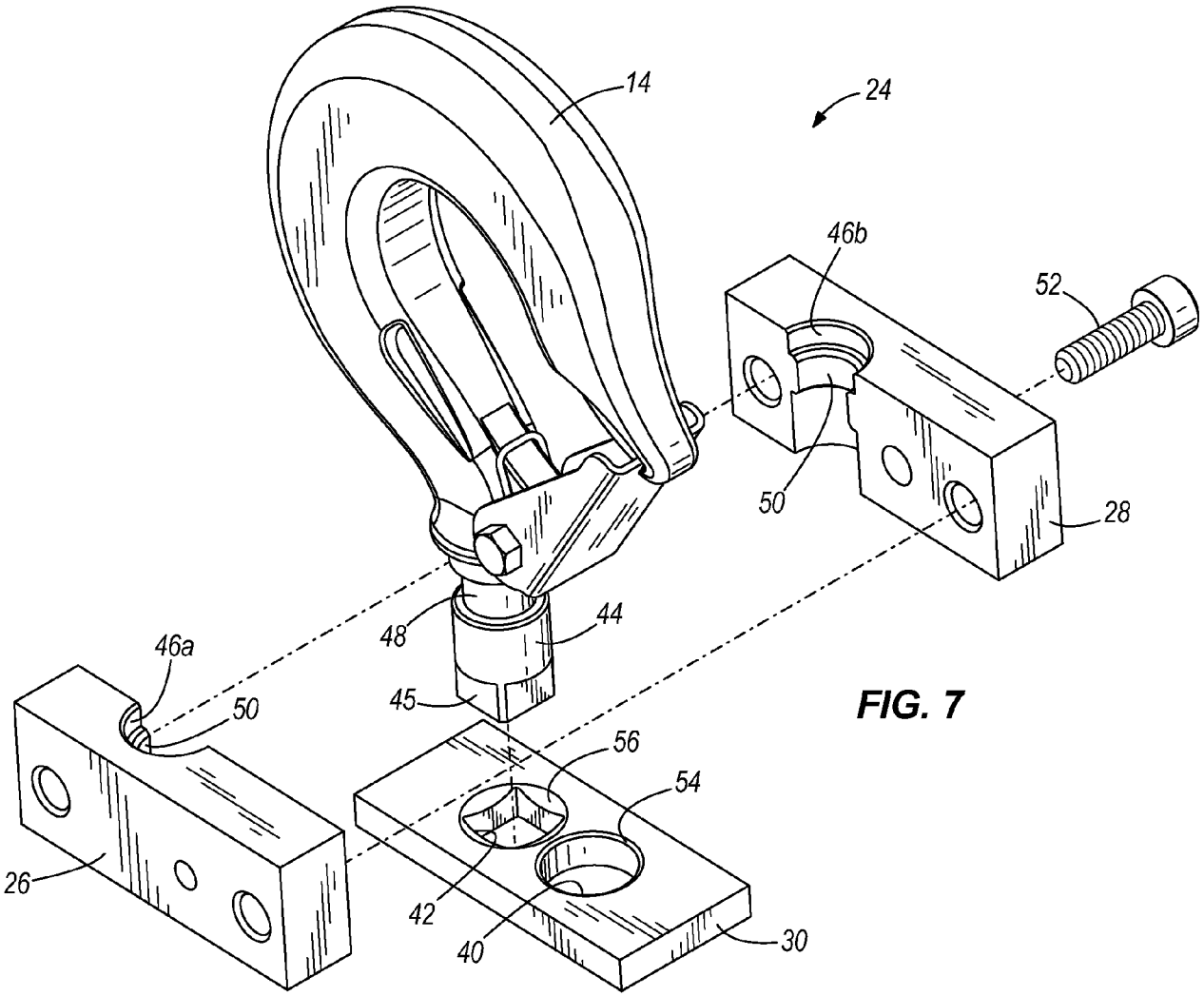
FIG. 7 is an exploded view of a hook sub-assembly of FIG. 1 including the plate in a second position.
Figure 8:
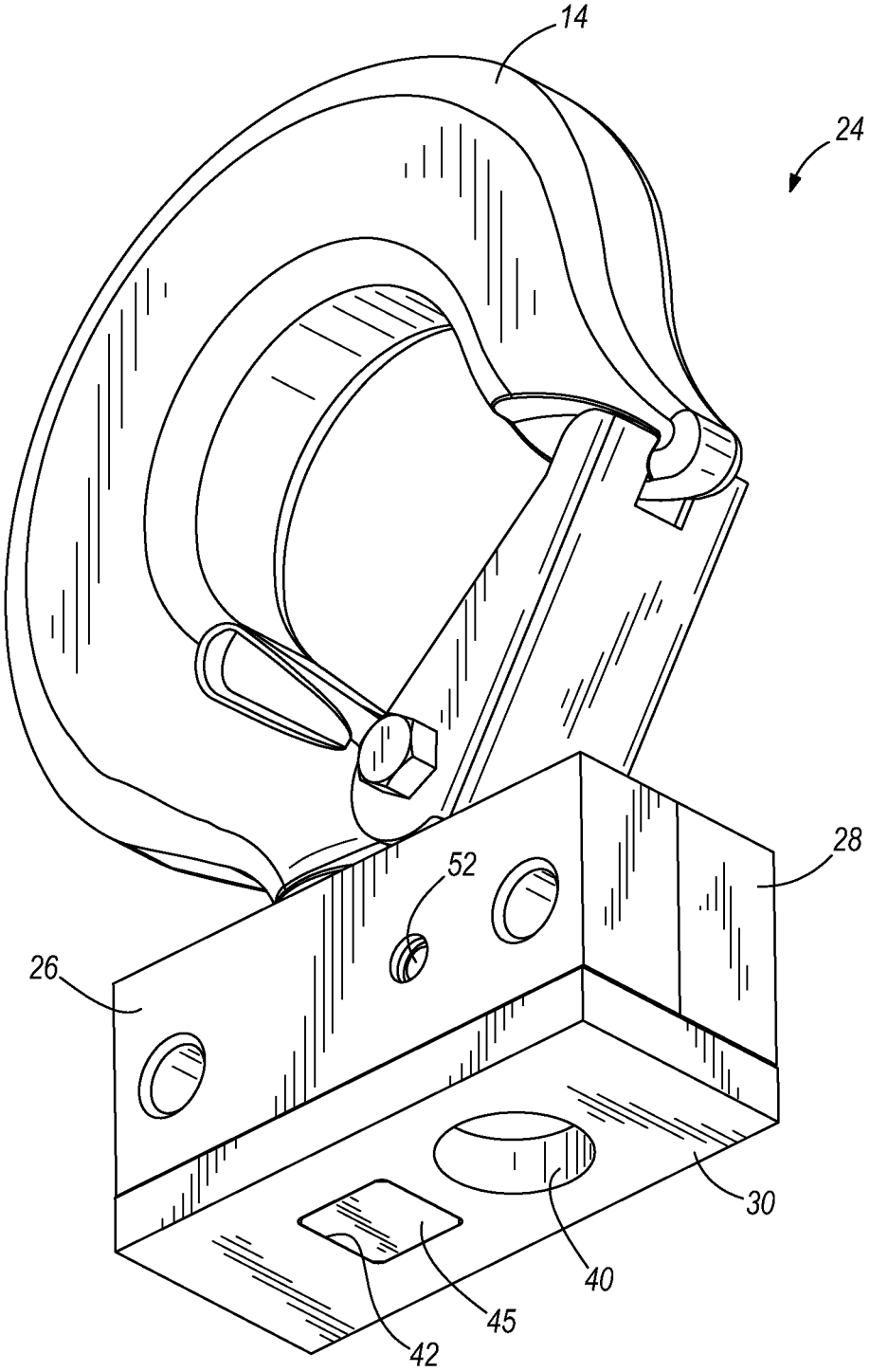
FIG. 8 is a bottom perspective view of the hook sub-assembly of FIG. 7.
Figure 9:
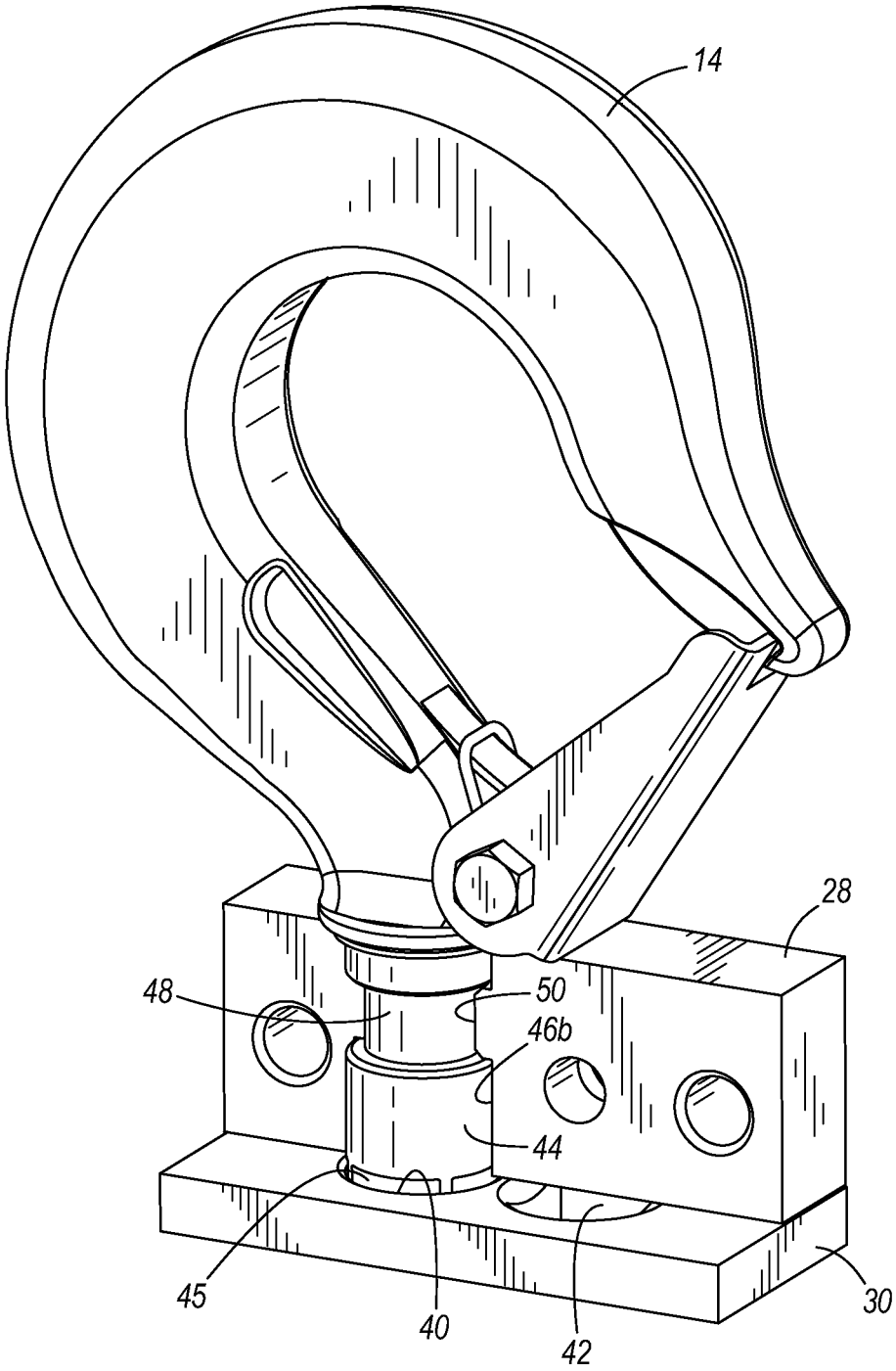
FIG. 9 is a perspective view of the hook sub assembly of FIGS. 7 and 8 with a portion removed for clarity.

FIGS. 7-9 show the attachment assembly 24 with the plate 30 in a second orientation with respect to the shank 44. In the second orientation, the polygonal end 45 of the shank 44 is at least partially inserted into the second aperture 42. The second aperture 42 is sized to receive the polygonal end 45 of the shank 44 and limit or inhibit rotation of the shank 44 with respect to the plate 30, which thereby limits or inhibits rotation of the hoist body 12 with respect to the top hook 14. The second aperture 42 is slightly larger than the polygonal end 45 to form a slip fit in the second aperture 42. Consequently, slight rotational movement of the polygonal end 45 within the second aperture 42 is permitted, but substantial rotation of the polygonal end 45 within the second aperture 42 is inhibited.

In the illustrated embodiment, the polygonal end 45 and the second aperture 42 are square in shape. Thus, the hoist body 12 can be positioned at four distinct orientations, spaced-apart in ninety degree increments, namely 0°, 90°, 180° or 270°, with respect to the top hook 14. In other embodiments, other polygonal shapes, such as a triangle, a pentagon, a hexagon, an octagon, and the like, can be utilized. In still other embodiments, non-polygonal shapes, such as a five point star, a six point star, and the like, can be utilized.

The quantity and angle of the orientations for a specific embodiment depend primarily upon the geometry of the polygonal end 45 and the second aperture 42. In some embodiments, the polygonal end 45 and the second aperture 42 have the same shape, whereas in other embodiments, the polygonal end 45 and the second aperture 42 can have different shapes that are compatible with one another (a triangle shank in a six-sided star aperture, for example).

In order to rotate the plate 30 from the first orientation to the second orientation and vice versa, a user removes the fasteners 32 from the hoist body 12 and the first and second blocks 26, 28. The hoist body 12 is removed from the first and second blocks 26 and 28 and top hook 14. The plate 30 is removed from the blind hole 34 in the hoist body 12 and rotated about the vertical axis 33. The plate 30 is re-inserted into the blind hole 34 and the first and second blocks 26, 28 are inserted into the blind hole 34. The polygonal end 45 of the shank 44 is inserted into the other of the apertures in the plate 30. The fasteners 32 are re-inserted into the hoist body 12 and first and second blocks 26, 28 and are tightened to couple the top hook 14 to the hoist body 12. This process is repeated whenever it is desired to alter the relationship between the hoist body 12 and the top hook 14, for example, to permit or resist rotation of the hoist body 12 with respect to the top hook 14. If free rotation of the hoist body 12 with respect to the top hook 14 is desired, the plate 30 can optionally be omitted.

The illustrated top hook 14 includes a substantially c-shaped hook that defines an opening and includes a clasp that is moveable to substantially cover the opening. In other embodiments, the attachment member is a trolley mount or other similar mounting device.

The illustrated arrangement selectively permits or inhibits rotation of the hoist body 12 with respect to the top hook 14 without adding or removing different parts. The same plate 30 is used to both inhibit and permit rotation of the hoist body 12 with respect to the top hook 14. This is advantageous because the same structure is utilized for both functions, i.e. no extra parts, fasteners, pins, screws, clamps or the like are needed. Furthermore, it permits the same top hook 14 to be utilized with a hoist body 12 in which the user can determine the rotational relationship between the hoist body 12 and the top hook 14 without requiring additional components or separate top hook assemblies.

Various features and advantages of the invention are set forth in the following claims.

What is claimed is:

1. A hoist assembly for overhead lifting, the hoist assembly comprising:

an upwardly extending attachment member including a downwardly depending shank having a polygonal cross sectional shape;

a hoist body coupled to the downwardly depending shank; and a plate positioned between the upwardly extending attachment member and the hoist body and defining a first circular aperture that matingly receives the polygonal shank and a second polygonal aperture laterally spaced from the first circular aperture, the plate is moveable between a first position in which the polygonal shank extends into the first circular aperture and a second position in which the polygonal shank extends into the second polygonal aperture, wherein rotation of the attachment member with respect to the plate is permitted when the plate is in the first position and rotation of the attachment member with respect to the plate is inhibited when the plate is in the second position.

2. The hoist assembly of claim 1, wherein the attachment member includes a generally c-shaped hook that defines an opening and a clasp moveable to substantially cover the opening.

3. The hoist assembly of claim 1, further comprising a first block defining a first recess and a second block defining a second recess, the first and second blocks are positioned to receive at least a portion of the downwardly depending shank within the first and second recesses.

4. The hoist assembly of claim 3, wherein the hoist body defines a recess sized to receive the plate and at least a portion of the first and second blocks.

5. The hoist assembly of claim 1, wherein the second polygonal aperture is generally square and the polygonal shank is generally square, such that the square shank can be fixed with respect to the hoist body in four different position, spaced apart about ninety degrees from adjacent positions.

6. The hoist assembly of claim 5, wherein the square aperture is slightly larger than the square shank to permit limited movement of the shank with respect to the hoist body.

7. The hoist assembly of claim 5, wherein the first circular aperture is sized to permit the square shank to rotate freely within the first circular aperture.

8. The hoist assembly of claim 1, wherein the plate defines a first bevel extending substantially around the first aperture to guide the polygonal shank in the first aperture and a second bevel extending substantially around the second aperture to guide the polygonal shank in the second aperture.

9. A method of coupling an attachment member to a hoist body, the method comprising:

positioning a plate between the attachment member and the hoist body in a first plate position, the plate having a first aperture and a second aperture;

inserting a shank of the attachment member through the first aperture into a mating recess in the hoist body to couple the attachment member to the hoist body;

rotating the hoist body with respect to the attachment member;

extracting the shank from the hoist body;

moving the plate from the first plate position to a second plate position;

inserting the shank through the second aperture into the mating recess in the hoist body to couple the attachment member to the hoist body; and inhibiting rotation of the hoist body with respect to the attachment member.

10. The method of claim 9, further comprising coupling a first member to a second member to define a substantially cylindrical aperture and inserting the shank into the substantially cylindrical aperture.

11. The method of claim 10, wherein positioning the plate between the attachment member and the hoist body comprises inserting the plate into the mating recess in the hoist body and retaining the plate in the mating recess with the first and second members.

12. The method of claim 9, further comprising rotating the hoist body with respect to the attachment member to one of a plurality of fixed positions prior to inserting the shank through the second aperture.

13. The method of claim 9, further comprising orienting the hoist body with respect to the attachment member prior to inhibiting rotation of the hoist body with respect to the attachment member.

14. The method of claim 9, further comprising orienting the hoist body with respect to the attachment member in one of four fixed positions, in which the fixed positions are each spaced apart about ninety degrees.

15. An attachment assembly for coupling a hoist body to a support structure to selectively permit and inhibit rotation of the hoist body with respect to the support structure, the attachment assembly comprising:

an attachment member including a first end and a second end, the first end connectable to the support structure, and the second end defining a shank having a polygonal cross sectional shape;

a receiving member that defines a through hole sized to receive the shank and permit rotation of the shank with respect to the receiving member; and a key member defining a first circular aperture and a second polygonal aperture spaced from the first aperture, such that in a first position, the shank extends into the first circular aperture to permit rotation of the attachment member with respect to the receiving member and in a second position, the shank extends into the second polygonal aperture to inhibit rotation of the attachment member with respect to the receiving member.

16. The attachment assembly of claim 15, wherein the receiving member includes a first block portion and a second block portion, such that the first block portion and the second block portion substantially surround the shank.

17. The attachment assembly of claim 15, wherein the second polygonal aperture is generally square and the polygonal shank is generally square, such that the square shank can be fixed with respect to the hoist body in four different position, spaced apart about ninety degrees from adjacent positions.

18. The hoist assembly of claim 17, wherein the square aperture is slightly larger than the square shank to permit limited movement of the shank with respect to the hoist body.

19. The hoist assembly of claim 17, wherein the first circular aperture is sized to permit the square shank to rotate freely within the first circular aperture.

20. The hoist assembly of claim 15, wherein the key defines a first bevel extending substantially around the first aperture to guide the polygonal shank in the first aperture and a second bevel extending substantially around the second aperture to guide the polygonal shank in the second aperture.

* * * * *